United States Patent [19]

Johansson et al.

[11] Patent Number: 4,770,012

[45] **Date of Patent: * Sep. 13, 1988**

[54] ELECTRONIC DIGITAL COMBINATION LOCK

[75] Inventors: Fritz H. Johansson, San Jose; Gordon P. Hampton, Cupertino, both of Calif.

[73] Assignee: Intelock Corporation, San Ramon, Calif.

[ * ] Notice: The portion of the term of this patent subsequent to Jul. 3, 2001 has been disclaimed.

[21] Appl. No.: 852,580

[22] Filed: Apr. 17, 1986

Related U.S. Application Data

[63] Continuation of Ser. No. 603,637, Apr. 25, 1984, which is a continuation of Ser. No. 267,813, Apr. 27, 1981, Pat. No. 4,457,148, which is a continuation of Ser. No. 925,385, Jul. 17, 1978, abandoned.

[51] Int. Cl.[4] ..... E05B 49/00

[52] U.S. Cl. ..... 70/278; 70/277

[58] Field of Search ..... 70/277–283, 70/468–482, 485, 487, 224; 200/61.64, 61.67; 361/172

[56] References Cited

U.S. PATENT DOCUMENTS

| | | |
|---|---|---|
| 656,808 | 8/1900 | Carleton . |
| 1,447,852 | 3/1923 | Huttemann . |
| 2,662,388 | 12/1953 | Hillgren . |
| 3,235,300 | 2/1966 | McRae et al. . |
| 3,656,327 | 4/1972 | Ford et al. . |
| 3,660,729 | 5/1972 | James et al. . |
| 3,766,522 | 10/1973 | Marsh . |
| 3,812,403 | 5/1974 | Gartner . |
| 4,019,355 | 4/1977 | Germanton . |
| 4,148,092 | 4/1979 | Martin . |
| 4,196,422 | 4/1980 | Swigert et al. . |
| 4,457,148 | 7/1984 | Johansson et al. . |

FOREIGN PATENT DOCUMENTS

| | | |
|---|---|---|
| 413883 | 8/1910 | France . |
| 7341700 | 6/1975 | France . |
| 5183 | 3/1900 | United Kingdom . |

*Primary Examiner*—Robert L. Wolfe

*Attorney, Agent, or Firm*—Flehr, Hohbach, Test, Albritton & Herbert

[57] ABSTRACT

An electronic digital combination lock including a frame supported within the interior of a door; a bolt mechanism which moves in relation to the frame to be retracted from a door jamb to open the door; a logic circuit which generates a control signal in response to entry of a predetermined combination signal, including push button switches which are housed within the door interior and produce bits when selectively depressed; and, a rotatable handle member which is coupled to the frame from the outside surface of the door to activate the bolt mechanism, including a tube that is coupled adjacent the push button switches and is selectively rotatable to depress each of the switches to generate the predetermined combination signal. The handle member including the tube has only limited rotational movement until the correct combination signal is entered, at which time an electromagnetic and lever mechanism is energized to release the handle member for extended rotation to retract the bolt mechanism.

9 Claims, 3 Drawing Sheets

ELECTRONIC DIGITAL COMBINATION LOCK

This is a continuation, of application Ser. No. 603,637, filed Apr. 25, 1984, which was a continuation, of application Ser. No. 267,813, filed May 27, 1981, now U.S. Pat. No. 4,457,148, which was a continuation of application Ser. No. 925,385, filed July 17, 1978, now abandoned.

BACKGROUND OF THE INVENTION

This invention relates to a lock and, more particularly, to an electronic digital combination lock for preventing access to an enclosure without the correct combination.

Electronic combination locks are currently in wide commercial use to control access to protected areas. These locks eliminate the need for a key and with it the problems associated with loss, theft or duplication of the keys. Access is gained to the protected area when the correct combination is entered into the lock, whereby the lock will be opened.

In one type of electronic digital combination lock, a panel of push buttons is mounted on a wall near a door, outside the protected area, while an electronic control box is mounted on the wall on the inside of the protected area. The panel may have ten numbered buttons and by pressing, for example, four buttons in proper sequence corresponding to the combination, a circuit in the control box will be activated to energize a solenoid of an electric door strike to allow the door to be opened.

Such a push button combination lock suffers from a number of disadvantages. After a short period of use of depressing the four buttons of the combination, they will show some wear that will at least partially reveal the combination. Also, installation of the electronic push button lock is relatively expensive since there is required the running of multiconductor cables between the panel and the control box and between the control box and the door strike, as well as the mounting of the panel, box and door strike on the wall. This installation also requires defacing of the wall to accomplish the needed mounting and running of the cables when,for example, an existing mechanical lock is being replaced with the electronic lock. In addition to the installation costs, the push button panel, the control box and the door strike are relatively expensive items, thereby adding to the cost of the lock. Furthermore, the electrical power requirement of this type of electronic lock is so great that the power source is typically an existing 115 volt AC supply, with battery operation being used only for emergency standby in the case of power failure. The need for this battery also increases the cost of the lock.

In another type of electronic digital combination lock, particularly that shown in U.S. Pat. No. 4,019,355, a set of push buttons is exposed on the surface of a door knob or handle. The lock is opened by simultaneously depressing one or more of the push buttons for each digit in a multi-digit combination and rotating the door handle while the buttons are depressed for each digit. When the correct combination is entered, an electromagnet is energized to permit the door handle to be rotated sufficiently to retract a bolt out of a mating recess in an adjacent door jamb for access to the protected area.

While the above patented electronic combination lock has the advantages of utilizing an electronic circuit requiring low power consumption so that it is battery operated, and of not requiring the mounting of a push button panel on a wall adjacent the door, it has disadvantages which make it unsuitable for commercial use. Manipulation of this patented lock is relatively difficult since it requires depressing the push buttons while simultaneously rotating the door handle to open the lock. Also, in addition to the push buttons, the electronic circuitry requires the use of a relatively large number of physical switches mounted internally on or in relation to the door handle to open the lock, together with a relatively complicated logic circuit that would not make it compatible for production on an inexpensive integrated circuit board in view of the many circuit connections that would be required for connection to the board. Still further, the mechanical structure of the patented lock constitutes a complete departure from prior mechanical locks. Consequently, it does not have the desirable feature of being a relatively simple variation of an existing lock, which would, for example, make for reduced costs in design and manufacturing.

SUMMARY OF THE INVENTION

It is an object of the present invention to provide a novel lock.

It is another object of the present invention to provide an electronic combination lock which requires no exposed push buttons and is relatively easy to manipulate.

Another object of the present invention is to provide an electronic combination lock which is a relatively simple improvement over prior mechanical locks and which can be manipulated in substantially the same manner as the prior mechanical locks to, for example, open a door.

A still further object of the present invention is to provide such a combination lock which requires no external electrical connections through a wall or the like, nor the mounting of push button panels or control boxes on the wall, to make replacement of an existing mechanical lock relatively easy and inexpensive.

A yet further object of the present invention is to provide an electronic digital combination lock which has simple logic circuitry with a minimum of interconnects, making it compatible for manufacturing as a single custom integrated circuit for placement inside a door handle.

Another object of the present invention is to provide an electromechanical combination lock which has very low power consumption.

These and other objects of the present invention are obtained through the use of an electronic digital combination lock having a frame; bolt means for moving in relation to the frame; electronic circuit means, responsive to a predetermined combination signal, for generating a control signal, including switch means selectively actuatable for generating digital signals; movable handle means, coupled to the frame, for moving the bolt means; and means, responsive to the control signal, for permitting the handle means to move the bolt means a certain distance. The handle means includes means, selectively movable, for controlling the switch means to produce the predetermined combination signal.

The invention also includes a lock having a handle means, movable in one or another direction, for unlocking the lock when moved in the one direction, movable means for blocking movement of the handle means in the one direction to unlock the lock, and energizable electromagnetic means for maintaining the movable means from blocking the handle means so that the handle means may be moved in the one direction to unlock the lock. The handle means includes means for moving the movable means to unblock the handle means when the handle means is moved in the other direction.

DETAILED DESCRIPTION OF THE PREFERRED EMBODIMENT

Figure 1:
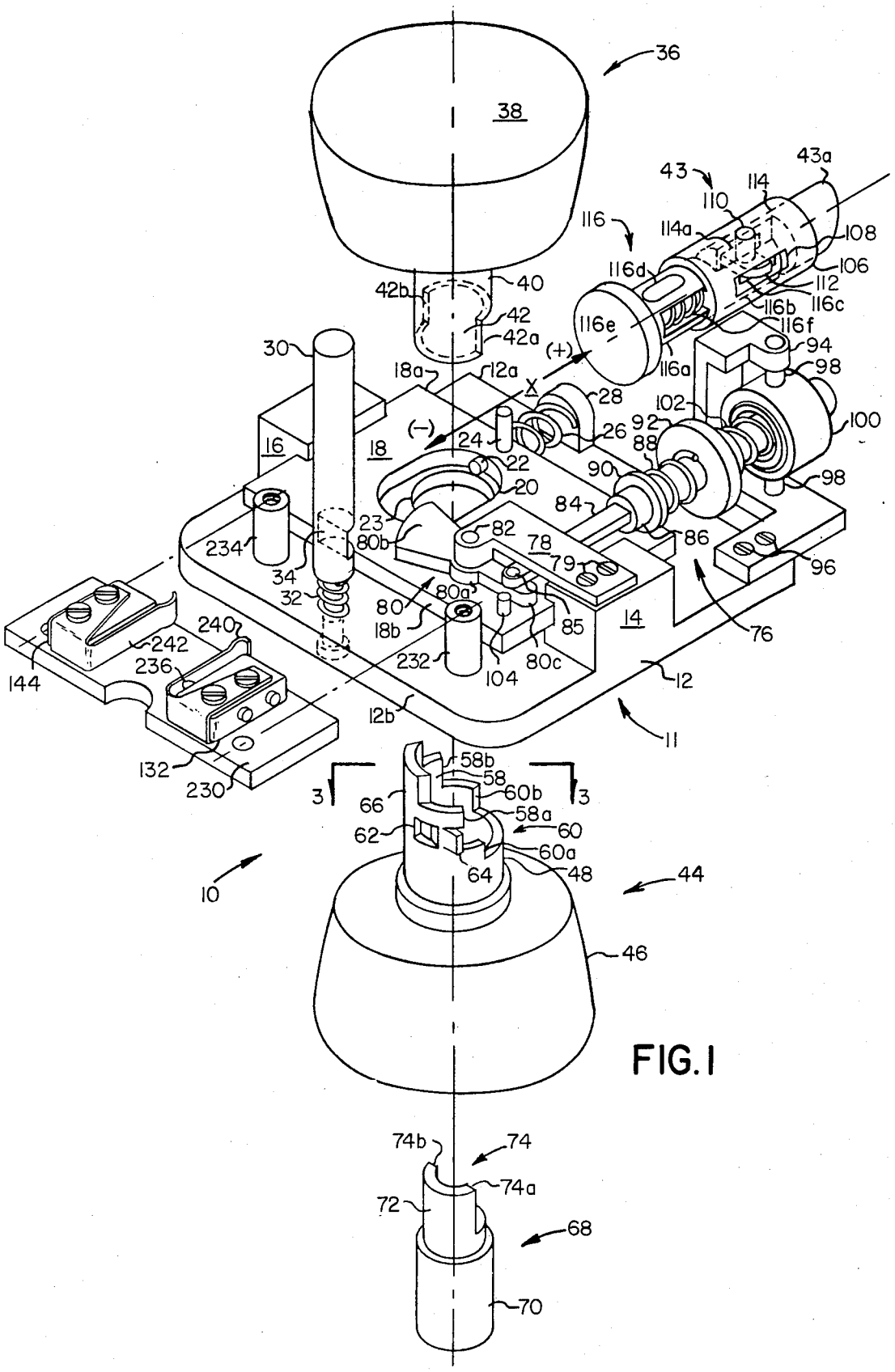
FIG. 1 is an exploded view of the mechanical structure of the combination lock of the invention.

With reference to FIG. 1, there is shown part of a combination lock 10 of the invention, particularly the mechanical structure 11. As will be described, this mechanical structure 11 is similar to a mechanical lock manufactured by the Weslock Company, Los Angeles, Calif., part No. 09710, differing in the use of some simple additional components and in a simple modification of an existing component of the Weslock lock.

The mechanical structure 11 includes a frame or main body 12 having a pair of guide rails 14 and 16 on either side of the body 12. A rectangular latch plate 18 is slidable along the guide rails 14 and 16 and back and forth in the + or − X direction shown in FIG. 1. The latch plate 18 has an oblong opening 20 in which a locking pin 22 extends to prevent the lock 10 from being unlocked. The frame 12 also has a round opening 23 that is partially coextensive with opening 20. Movement of the plate 18 in the − X direction will cause the pin 22 to be placed in position in which the lock 10 is locked, while movement in the + X direction will place the pin 22 in a position in which the lock 10 is unlocked.

The latch plate 18 has a vertically extending pin 24 which is used to move this plate 18 in the + X direction. A spring 26 is disposed between a bracket 28 mounted at one side 12*a* of the frame 12 and one side 18*a* of the latch plate 18 to bias the latter in the − X direction. At the opposite side 12*b* of the frame 12, an elongated vertically extending shaft 30 sits on a spring 32 which is disposed between the lower end of shaft 30 and the top surface of frame 12. Shaft 30 is biased upwardly by spring 32 and has a slot 34 for receiving a side edge 18*b* of the latch plate 18 when the lock 10 is locked.

Figure 2:
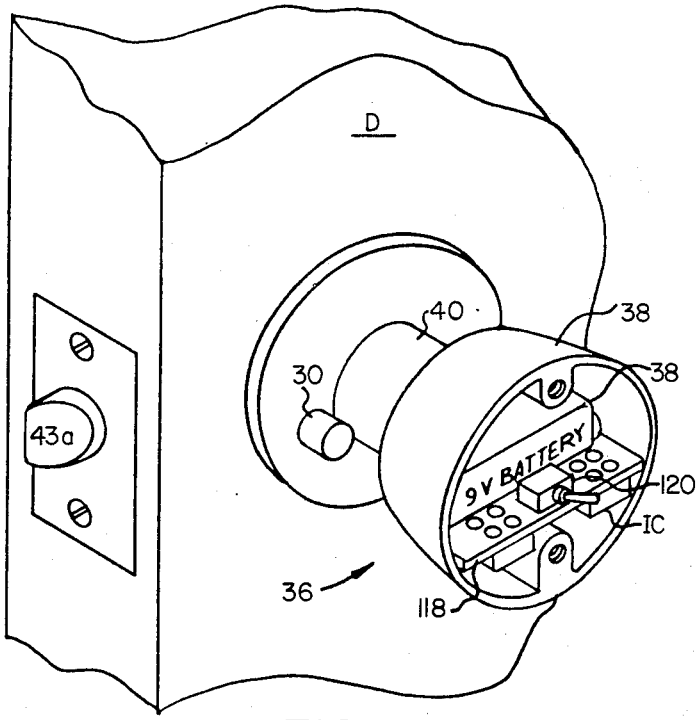
FIG. 2 is a perspective view of an inside handle member of the invention mounted on the inside of a door.

A rotatable handle member 36 has a cylindrical handle 38 and a tube 40 extending from the handle 38 into the openings 20 and 23 of latch plate 18 and frame 12, respectively. Tube 40 has a semi-circular cutout 42 providing two surfaces 42*a* and 42*b*, either of which may be used to operate a bolt mechanism 43 having a bolt 43*a*, to retract the bolt from a door jamb (not shown) to allow a door D shown in FIG. 2 to be opened. As illustrated in FIG. 2, the shaft 30 and handle member 36 are mounted on the surface of the door D facing the interior of a protected area such as a room in a house, with the frame 12 being supported within the interior of the door D. The shaft 30 is a commonly known member which can be pressed inwardly to lock the lock 10 from the inside; however, as will be described, in addition to retracting the bolt 43*a*, rotation of the inside handle member 36 will automatically unlock the lock 10 without the need for any combination or key.

Figure 3:
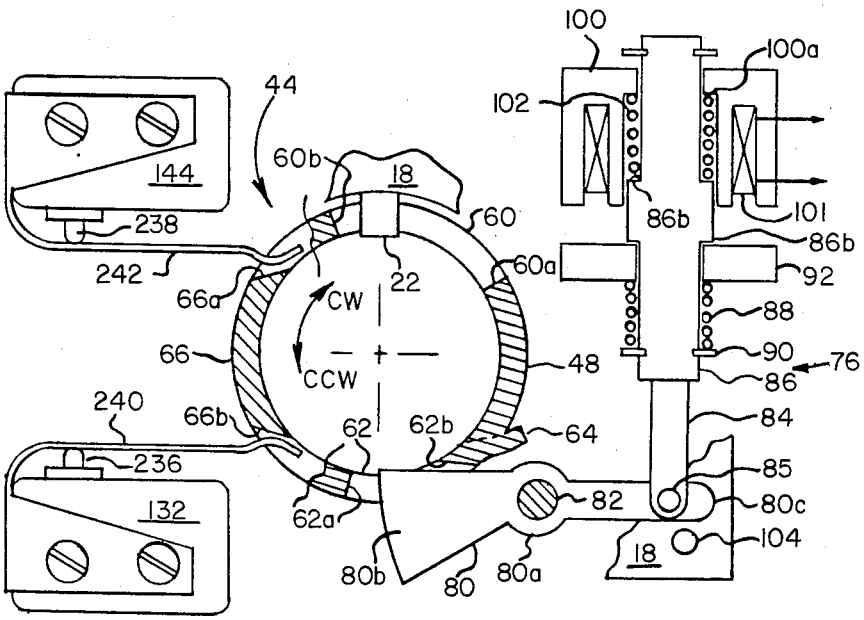
FIG. 3 is a view partially broken away and taken along the lines 3—3 of FIG. 1 of an outside handle member as assembled in the lock.

Another rotatable handle member 44, which would be assembled on frame 12 and latch plate 18 from the outer side of door D, has a handle 46 and a tube 48 extending through the openings 23 and 20 of the frame 12 and latch plate 18. Tube 48 extends about the outside circumference of tube 40 to be concentric with the latter. Tube 48 has a semi-circular cutout 58 defined by two surfaces 58*a* and 58*b*, either of which may be rotated to operate bolt mechanism 43 to retract the bolt 43*a* out of engagement with the door jamb. Tube 48 has another semi circular cutout 60 defined by two surfaces 60*a* and 60*b*, between which, as shown in FIG. 3, the locking pin 22 is insertable to prevent rotation of the handle member 44 a sufficient amount in one direction when the lock 10 is locked, so that the bolt 43*a* cannot be retracted from the door jamb to open the door D. As shown in FIGS. 1 and 3, tube 48 also has a slot 62 defined by two surfaces 62*a* and 62*b*, a tang 64 extending outwardly from the tube 48, and a semi-circular tube section 66 providing two inclined surfaces 66*a*, 66*b*, all of whose functions will be described below. It may be noted at this time, however, that it is the handle member 44 which is rotatable a limited amount to generate a digital combination signal to unlock the lock 10 from the outside of the door D, and then is rotatable an extended amount to move the bolt 43*a* a certain distance to retract it from the door jamb to open the door D.

While the lock 10 may be unlocked with the proper combination by manipulating handle member 44, or may be unlocked without the combination by the handle member 36, it also may be opened with a conventional key. This is accomplished with a key lock mechanism 68, shown in FIG. 1, which has a cylindrical member 70 into which a key may be inserted and a tube 72 which extends concentrically within the tube 48, through the openings 23 and 20 of frame 12 and latch plate 18, respectively, and into the tube 40 of inside handle member 36. Tube 72 has a semi-circular cutout 74 defined by two surfaces 74*a* and 74*b*, each of which may be used to operate the bolt mechanism 43 to move the bolt 43*a* out of the door jamb when the key is inserted to rotate tube 72. Consequently, it may be seen that with the handle members 36 and 44 and the key lock mechanism 68 assembled through openings 20, 23, in cross-section through the semi-circular cutouts 42, 58 and 74, there would appear outer surfaces 58*a*, 58*b*, intermediate surfaces 42*a*, 42*b* and inner surfaces 74*a*, 74*b*, each of which being in contact with mechanism 43. Each of the tubes 40, 48 and 72, as may be appreciated, is independently rotatable to operate the bolt mechanism 43.

A mechanism shown generally at 76 is used to release the handle member 44 for extended rotation after the correct combination has been generated to retract the bolt 43*a*. The mechanism 76, as shown in FIGS. 1 and 3, includes a plate 78 that is connected at one end to the guide rail 14 with screws 79 and extends over the latch plate 18. A lever 80 is rotatably connected at a central portion 80*a* to the other end of plate 78 by a pivot pin 82. Lever 80 has one end 80*b* which is movable into slot 62 to prevent extended rotation of the handle member 44. A bar 84 is pivotally connected at one end to the other end 80*c* of lever 80 by a pivot pin 85 and has its other end connected to a rod 86. A compression spring 88 is disposed between a ring 90 fixedly connected about rod 86 and a ring 92 slidably connected about rod 86 to bias the ring 92 against an annular shoulder 86*a* of the rod 86. A bracket 94 is connected to the frame 12 with screws 96 and has a pair of pins 98 for supporting an electromagnet 100 having a coil 101 which, when energized, holds the ring 92 against the magnet 100. A spring 102 is disposed between a shoulder 86*b* of the rod 86 and a shoulder 100*a* of the electromagnet 100 to bias the rod 86 and, hence, lever 84 into the position shown in FIG. 3, whereby the lever 80 has its end 80*b* within the slot 62. A pin 104 extends from the latch plate 18 adjacent the end 80*c* of lever 80 to move with the latch plate 18 and rotate the lever 80 about the pivot pin 82 during movement of the pin 104 in the + X direction, whereby end 80*b* will be removed from the slot 62.

The bolt mechanism 43 includes a hollow cylindrical tube 106 which has an elongated slot 108, a pivot pin 110 connected to tube 106, and a lever 112 which can pivot about the pin 110. The bolt 43*a* extends from one end of the tube 106 and is movable in the + or − X direction into and out of the door jamb (not shown). Bolt 43*a* has an arm 114 extending into and along one side of the tube 106, this arm 114 having an elongated slot 114*a* into which one end of the lever 112 extends. An actuator 116, which is movable in the + or − X direction to move the bolt 43*a* in the − or + direction, respectively, includes a rod 116*a* extending outwardly from the other end of the tube 106 and an arm 116*b* extending into the tube 106 opposite the arm 114. The other end of lever 112 extends through an elongated slot 116*c* in the arm 116*b* and into the slot 108. Rod 116*a* has two oppositely positioned slots 116*d* (only one shown) which receives the pin 24 on the latch plate 18. A plate or disk 116*e* of actuator 116 is connected to the outer end of rod 116*a* to be in contact with the surfaces 42*a*, 42*b* of handle member 36, surfaces 58*a*, 58*b* of handle member 44, and surfaces 74*a*, 74*b* of key lock mechanism 68. Actuator 116 is biased in the − X direction by a spring 116*f* disposed between the disk 116*e* and the tube 106.

The bolt mechanism 43 operates in the following manner. When the actuator 116 is moved a certain distance in the + X direction, arm 116*b* rotates lever 112 in a counterclockwise direction about pivot pin 110 as viewed from the top of pin 110. Since lever 112 extends within slot 114*a* of bolt arm 114, the arm 114 and hence the bolt 43*a* are moved in the − X direction, whereby bolt 43*a* can be removed from the door jamb. When actuator 116 is moved a certain distance in the − X direction, the arm 116*b* causes lever 112 to rotate in the clockwise direction about the pivot pin 110. Consequently, lever 112 will then cause bolt arm 114*a* to move in the + X direction to return the bolt 43*a* into engagement with the door jamb.

Before describing the operation of the mechanical structure 11 of FIG. 1, it may be helpful to note the differences between this structure 11 and the Weslock lock mentioned previously. The structure 11 is similar to the Weslock lock except that it adds to it the mechanism 76, including the components 78–104, which is used to prevent unlocking the lock with handle member 44 until the correct combination is entered, as will be described. Also, the Weslock lock has a handle member such as handle member 44; however, the Weslock handle member does not have the slot 62 and section 66, and the tang 64. Also, the circumferential spacing between surfaces 60*a* and 60*b* of the Weslock lock is much smaller than that shown in FIG. 1. In all other respects, the mechanical structure 11 of FIG. 1 already described is substantially similar to the Weslock lock.

The manner is which the bolt 43*a* may be retracted from a door jamb to open the door D will now be described. As already noted, with the mechanical structure 11 of lock 10 in its assembled state, the tubes 40, 48 and 72 will be concentric and plate 116e will be adjacent the surfaces 42*a*, 42*b*, 58*a*, 58*b*, 74*a* and 74*b*. Also as already mentioned, the handle members 36 and 44 and the key lock mechanism 68 are individually rotatable to operate the bolt mechanism 43 to move the bolt 43*a* from the door jamb.

Assume that the mechanical structure 11 shown in FIG. 1 is in a locked position of the lock 10. In this locked condition, the shaft 30 wil be depressed against the bias of spring 32 to align the slot 34 with the side edge 18*b* of latch plate 18. Until this alignment occurs, the side edge 18*b* will be held in a + X position against the lower peripheral surface of the pin 30 which acts against the bias of spring 26. With the slot 34 aligned with the side edge 18*b*, spring 26 will cause the latch plate 18 to slide in rails 14, 16 in the − X direction to bring side edge 18*b* into the slot 34. In this locked condition, as shown more clearly in FIG. 3, the locking pin 22 will be positioned in semi-circular cutout 60 between the surfaces 60*a* and 60*b* of outside handle member 44. Also, lever 80 will be biased with its end 80*b* extending into slot 62, as shown in FIG. 3. As will be described in more detail, in this FIG. 3 position of the locking pin 22 and lever 80, the outside handle member 44 will not be able to be rotated a sufficient amount to move actuator 116 a sufficient distance so that bolt 43*a* can not be released from the door jamb. However, inside handle member 36 will be able to be rotated a sufficient amount to unlock the lock 10 and move actuator 116 a sufficient distance to retract bolt 43*a* from the door jamb without the need for any combination or key, while key lock mechanism 68 will be able to be rotated to unlock the lock 10 and move actuator 116 such a sufficient distance also without the combination, but only with the use of a suitable key, as will now be described.

When the inside handle member 36 is rotated in a clockwise or counterclockwise direction, either surface 42*a* or 42*b*, depending on the direction of rotation, will push actuator 116 in the + X direction a sufficient distance to cause bolt 43*a* to be retracted from the door jamb, whereby the door D can be opened. Also, as the actuator 116 is pushed in the + X direction, the slot 116d will move relative to the pin 24 until the edge of the slot 116*d* comes into contact with the pin 24. Contineued movement of the actuator 116 in the + X direction will cause such edge of slot 116*d* to move pin 24 in the + X direction to carry with it the latch plate 18. Consequently, the side edge 18*b* will be removed from the slot 34, causing the shaft to spring upwardly, so that the plate 18 will remain in this + X position. Thus, locking pin 22 will be removed from the semi-circular cutout 60 of handle member 44; also, pin 104 on latch plate 18 will be moved against the end 80*c* of lever 80 to rotate this lever about the pivot pin 82 and remove the end 80*b* from the slot 62. Therefore, the handle member 44 will now be able to be rotated a sufficient amount to move actuator 116 a certain distance to thereby remove the bolt 43*a* from the door jamb to open the door D from the outside without the need for any combination or key.

With the lock 10 in an unlocked condition, the mechanical structure 11 may then be placed in a locked condition by depressing shaft 30. This will align the slot 34 with the side edge 18*b*, enabling the spring 26 to move the plate 18 in the − X direction with the edge 18*b* coming to rest in the slot 34. Thus, locking pin 22 will move back into the semi-circular cutout 60 and pin 104 will move away from end 80*c*, enabling the end 80*b* of lever 80 to move into slot 62. Therefore, handle member 44 will not be allowed to rotate a sufficient distance to move actuator 116 to retract the bolt 43*a* out of the door jamb nor to cause latch plate 18 to slide in the + X direction a sufficient distance to unlock the lock 10 without the proper combination.

Also, with the lock 10 in the locked condition, a suitable key may be inserted into the key lock mechanism 68. With the appropriate key, tube 72 and surfaces 74*a*, 74*b* can be rotated a sufficient distance to move actuator 116 and hence latch plate 18 a sufficient distance in the + X direction to remove bolt 43*a* from the door jamb and unlock the lock 10 in a similar manner as described for handle member 36.

To unlock the lock 10 and open the door D with the handle member 44, the member 44 will have to be rotated in a counterclockwise direction as viewed in FIG. 3. When the correct combination has been entered by a final clockwise rotation of handle 44, the tang 64 will have rotated lever 80 counterclockwise and pushed ring 92 against electromagnet 100. At this time the electromagnet 100 will be energized for a preset short time to hold the ring 92 against the magnet 100, in which position the lever 80 will be rotated in the counterclockwise direction about pin 82 to remove end 80*b* from the slot 62. With end 80*b* removed from slot 62, and because there is a relatively long circumferential distance between pin 22 and surface 60*a* compared to the distance between pin 22 and surface 60*b*, handle member 44 will be able to rotate a sufficient distance in the counterclockwise direction to move, via its surface 58*a*, actuator 116 in the + X direction and with it the latch plate 18. Therefore, the side edge 18*b* will be moved out of the slot 34 causing shaft 30 to be biased upwardly into the unlocked position and bolt 43*a* will be withdrawn from the door jamb. Also pin 104 will be moved against the end 80*c* of lever 80 to maintain end 80*b* out of the slot 62 when the electromagnet 100 is de-energized. Consequently, the handle member 44 may then be used to open the door D without the combination until the shaft 20 again is depressed to lock the lock 10.

Figure 4:
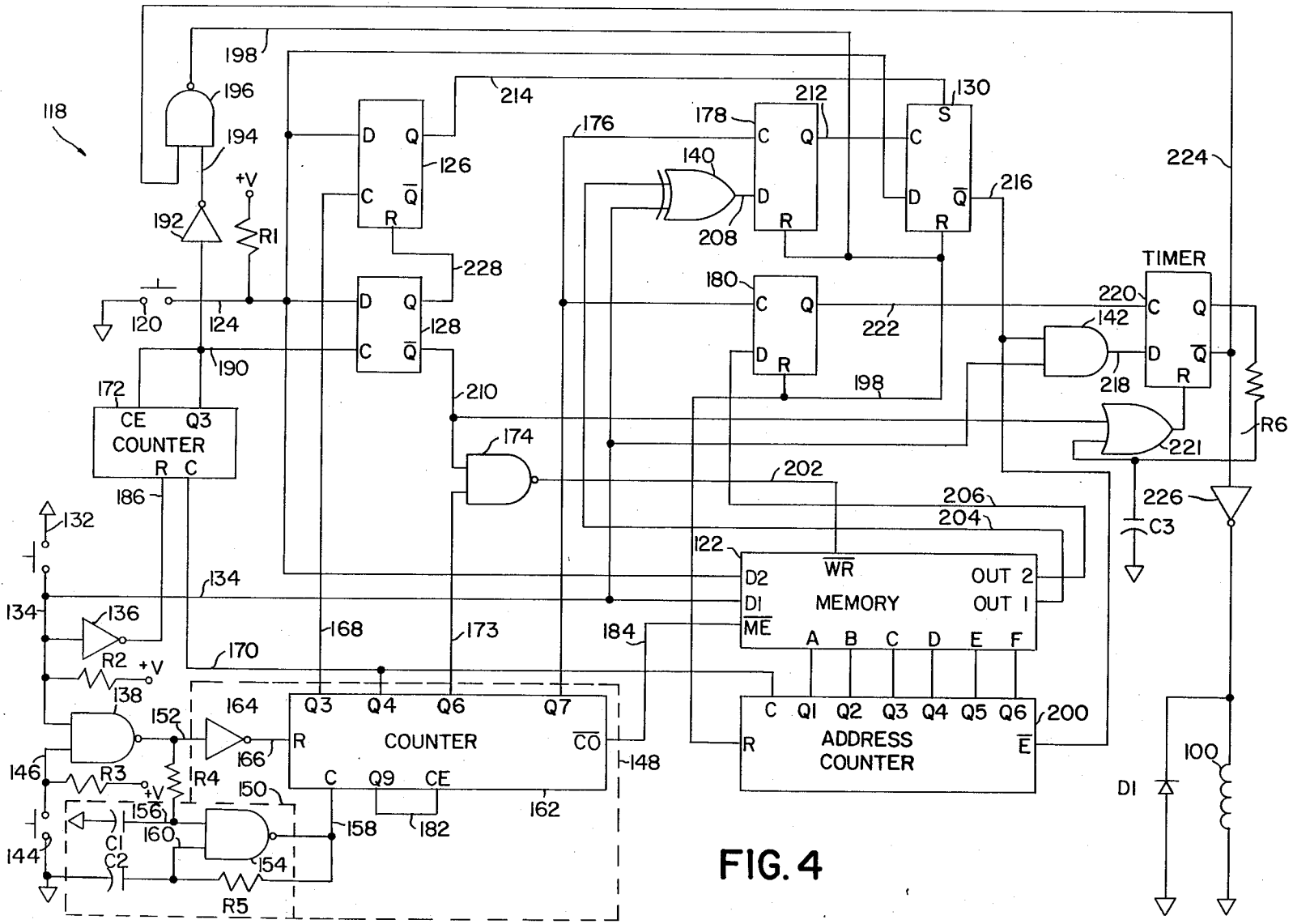
FIG. 4 is a block diagram of the electronic circuitry of the invention.

FIG. 4 illustrates an electronic logic circuit 118 which energizes the electromagnet 100 for a preset period of time when the correct combination has been entered. As one example, assume that the combination is 1, 2, with each of the digits 1 and 2 being a character or number. In accordance with the invention, this combination is represented by a signal constituting a sequence of 5 bits, which is 01001. The "0" bits define the characters of the combination while the "1" bits partition each character of the combination. Thus, reading from left to right in the digital sequence, the sequence is one "0" bit corresponding to the character 1, followed by a "1" bit to partition character 1, followed by two "0" bits corresponding to the character 2, followed by a "1" bit to partition the character 2. Of course, it will be appreciated that the polarity of the bits in the sequence can be reversed so that "1" could be used to define the characters of the combination while "0" could be used to partition each character. As will be described, this digital combination signal is stored in the circuit 118, which will not energize the electromagnet 100 until the combination is correctly entered by a user of the lock 10 correctly manipulating the handle member 44.

The circuit 118 includes a toggle switch 120, which also can be a push-button switch, which is utilized for storing or programming a digital combination signal into a read/write memory 122. The switch 120 is in a line 124 leading to the data input D of flip-flops 126, 128 and 130. The line 124 also leads to a data input D2 of the memory 122.

A normally open push button switch 132 is connected in a line 134 leading to an inverter 136 and one input of a NAND gate 158. The line 134 also leads to a data input D1 of the memory 122, to one input of an exclusive-OR gate or comparater 140, and to one input of an AND gate 142. The switch 132, among other purposes to be described, is actuated to enter the character or number of the combination into the memory 122. Each time the switch 132 is depressed, one bit of each character is generated so that, for example, two consecutive depressions of the switch 132 produces two consecutive "0" bits which are entered at the input D1 and correspond to the character 2 in the combination 1, 2.

A normally open push button switch 144 is connected in a line 146 which provides the other input of the NAND gate 138. The switch 144, among other purposes to be described, is actuated to enter the "1" bits into the memory 122 to partition the characters 1, 2 of the combination. Thus, for example, to enter the character 1 of the combination 1, 2, first the push button 132 is depressed once to store a "0" bit, followed by depression of the switch 144 to provide a "1" bit. A voltage +V is supplied to the respective lines 124, 134 and 146 through respective resistors $R_1$, $R_2$ and $R_3$.

A timing control 148 controls the movement of the data through the circuit 118. The control 148 includes an oscillator 150 which is energized by the output of the NAND gate 138 on a line 152 having an RC circuit of resistor $R_4$ and capacitor $C_1$. The oscillator 150 includes a NAND gate 154, with hysterisis on its inputs, having one input line 156 coupled between the resistor $R_4$ and capacitor $C_1$ and an output line 158 coupled back to the other input 160 via an RC network of resistor $R_5$ and capacitor $C_2$. When the input voltage on line 156 reaches, for example, 0.6V, the oscillator 150 begins to oscillate at a frequency of approximately 500 Hz. as determined by $R_5C_2$.

A decade counter 162 of the timing control 148 has a clock input C for counting the output pulses on line 158 from the oscillator 150. The counter 162 has a reset input R which is coupled to the output of an inverter 164 via a line 166, with the input to the inverter 164 being connected to the line 152. A signal on the line 166 removes the reset condition of the counter 162 enabling the counter to count the clock pulses at the input C.

The counter 162 has clock outputs $Q_3$, $Q_4$, $Q_6$, $Q_7$, $Q_9$, and $\overline{CO}$, together with a clock enable input CE. Output $Q_3$ is coupled via a line 168 to the clock input C of the flip-flop 126; output $Q_4$ is connected via a line 170 to the clock input C of a three-bit counter 172 constituting a reset pulse generator; output $Q_6$ is coupled via a line 173 as one input to a NAND gate 174; output $Q_7$ is coupled via a line 176 to the clock inputs C of respective flip-flops 178 and 180; and output $Q_9$ is coupled over a line 182 to the input CE to disable the counter 162. The output $\overline{CO}$ goes low in response to a fifth clock pulse counted by the counter 162, and stays low through the ninth clock pulse, to enable the memory 122 at its input $\overline{ME}$ via a line 184. Outposts $Q_3$, $Q_4$, $Q_6$, $Q_7$ and $Q_9$ are all high signals.

The counter or reset pulse generator 172 has a reset input R connected to the output of the inverter 136 via a line 186 to remove the reset condition on the counter 172. This will enable the counter 172 to count the clock pulses on the line 170 from the counter 162. The counter 172 has an output $Q_3$ coupled over a line 190 to the clock input C of the flip-flop 128, and to an inverter 192. The output of the inverter 192 on a line 194 is connected as one input to a NAND gate 196 whose output over a line 198 is used to reset the flip-flops 130, 178, and 180 at their respective inputs R. The output on line 198 is also fed to an address counter 200 to reset this counter at its input R. The address counter 200, after the reset is removed, will then count the clock pulses at its input C over the line 170 to address the memory 122. The output $Q_3$ of the counter 172 is also fed to its input CE to disable further counting after a count of 3 has been counted.

The memory 122 has a write enable input $\overline{WR}$ coupled to the output of the NAND gate 174 via a line 202. The memory 122 also has an output OUT1 for transferring the data stored via the input D1 over a line 204 as an input to the exclusive-OR gate 140, together with an output $OUT_2$ for transferring the data stored via the input D2 over a line 206 to the data input D of the flip-flop 180. The output of the exclusive-OR gate 140 is fed over a line 208 to the data input D of the flip-flop 178. The NAND gate 174 has an input coupled over a line 210 to the output $\overline{Q}$ of the flip-flop 128 for purposes of writing data into the memory 122. The signal on line 210 also disables a timer flip-flop 220 via an OR gate 221 at its input R.

The flip-flop 178 has an output Q coupled over a line 212 to the clock input C of the flip-flop 130. The flip-flop 130 has a set input S coupled over a line 214 to the output Q of the flip-flop 126, and an output $\overline{Q}$ coupled over a line 216 as an input to the AND gate 142. The output of the AND gate 142 is connected over a line 218 to the data input D of the timer flip-flop 220 which has a clock input C connected to the output Q of the flip-flop 180 via a line 222. The flip-flop 220 has an output Q coupled through an RC circuit including resistor $R_6$ and capacitor $C_3$ to its reset input R via OR gate 221. An output $\overline{Q}$ of the flip-flop 220 is coupled via a line 224 through an inverter 226 to energize the electromagnet 100 a preset period of time determined by $R_6C_3$, and to an input of the NAND gate 196 for providing a reset pulse over the line 198. The output on line 216 from the flip-flop 130 is also fed to an enable input $\overline{E}$ of the counter 200. The flip-flop 128 has an output Q coupled over a line 228 to the reset input R of the flip-flop 126.

Before discussing the operation of the circuit 118, reference should be made to FIGS. 1 and 3 to describe the location of the push button switches 132 and 144 and the manner in which they can be depressed. The switches 132 and 144, as illustrated in FIG. 1, are physically mounted on a board 230 which is supported on the frame 12 with a pair of tubes 232, 234. The tubes 232 and 234, together with the board 230, are connected to the frame 12 in a position that will enable the latch plate 18 to slide into the slot 34 of the shaft 30 as previously described. As shown in FIG. 3, each switch 132 and 144 includes a respective button 236 and 238 which may be depressed by the movement of respective spring arms 240 and 242. The arms 240 and 242 extend adjacent the inclined surfaces **66*b* and 66*a*, respectively. The movement of the handle member 44 in the clockwise direction will cause the surface 66*a* to contact the arm 242 and depress the button 238, whereby the switch 144 will be closed. The movement of the handle member 44 in a counterclockwise direction will cause contact of the surface 66*b* with the arm 240 to depress the button 236 and hence close the switch 132**.

There are several additional things to note about these switches 132 and 144. Their position shown in FIG. 3 is 90° in a clockwise direction away from their actual position as shown in FIG. 1 for purposes of clarity. Furthermore, the switches 132 and 144, as well as the board 230 and tubes 232 and 234 also are not part of the commercially available Westlock lock previously mentioned. Moreover, the switches 132 and 144, being so positioned on the frame 12, are not exposed outside the door D. It also should be noted that the actuator 116 is slightly modified over the commercial Westlock lock to provide sufficient motion in the actuator 116 to close the switches 132 and 144 with the handle member 44 without moving the bolt **43*a* from the doorjamb. Finally, a conventional spring (not shown) may be used to bias the handle member 44 back to a neutral position illustrated in FIG. 3 after the switch 132 or 144** is closed.

The switch 120, on the other hand, as shown in FIG. 2, is physically located in the interior of the hollow handle 38. This switch 120 would be opened and closed by direct manual control by the user of the lock 10. Alternatively, if the switch 120 is a push button switch, it can be mounted on the door D below the bolt **43*a* shown in FIG. 2**.

The position of the latch plate 18, the handle member 44, the mechanism 76, and the switches 132, 144 shown in FIG. 3 correspond to the locked condition of the lock 10. In this position, it should be noted that the locking pin 22 is more closely adjacent the surface **60*b* than the surface 60*a* to allow for only a partial clockwise rotation of the handle member 44 until this rotation is stopped by the contact between the surface 60*b* and the pin 22. Also, the end 80*b* of the lever 80 is within the slot 62 near the surface 62*a* and permits only partial counterclockwise rotation of the handle member 44, i.e., until this surface 62*a* comes into contact with the end 80*b*. This partial rotation is adequate to close the switches 132 and 144 but not to unlock the lock 10 or retract the bolt 43*a* from the doorjamb, as previously indicated. The positioning of the end 80*b* also is such that the movement of the handle member 44 in the clockwise direction will cause the tang 64 to come in contact with the end 80*b* and pivot the lever 80 a distance sufficient to cause the ring 92 to come in contact with the electromagnet 100** so that there is no air gap therebetween.

To describe the manner in which the lock 10 can be opened with the correct combination, assume that this lock 10 is installed on the door with some prior combination stored in the memory 122 and that it is in the locked condition shown in FIG. 3. Also assume that the power is on and a new combination is to be used, and therefore, must be stored in the memory 122. In keeping with the present example, this new combination is the number 1,2.

To store the new combination and then open the lock, the program switch 120 should first be closed. This will provide a low or "0" bit on the line 124. Thereafter, the address counter 200 should be initialized to zero and this is accomplished by three successive depressions of the switch 144.

On the first deprssion of the switch 144, which is accomplished by rotating the handle member 44 clockwise as shown in FIG. 3, a low signal is provided on the line 146 which results in a high signal from the NAND gate 138 on the line 152. The inverter 164 inverts this high signal to provide a low signal on line 166, whereby the counter 162 has its reset condition removed to count a sequence of clock pulses. When the high signal on the line 152 reaches, for example, 0.6V, the oscillator 150 will oscillate at the frequency of 500 Hz. to provide the clock pulses on the line 158. Each positive transition of the clock pulses on the line 158 causes the outputs $Q_0$–$Q_9$ to go high in succession, but only outputs $Q_3$, $Q_4$, $Q_6$, $Q_7$, $Q_9$ and $\overline{CO}$ are utilized as already indicated. On the third clock pulse counted by the counter 162, the output $Q_3$ on the line 168 goes high in an attempt to transfer the data from the input D of the flip-flop 126 to the output Q on the line 214. The input R of the flip-flop 126 is high since the flip-flop 128 has not yet toggled so the output Q of the flip-flop 126 remains low.

On the fourth clock pulse after the first depression of the switch 144, the counter 162 provides a high signal on the line 170, whereby the counter 172 is incremented to a count of 1. Thereafter, the counter 162 counts the succeeding pulses 5–9 but these have no relevance at this point in the operation of the circuit 118, except that the ninth pulse at the output $Q_9$ on the line 182 disables the counter from counting any further pulses from the oscillator 150. When the switch 144 is released after this first depression, the counter 162 is reset by the high on line 166 and the oscillator 150 de-energized.

On the second successive depression of the switch 144, the counter 162 again commences counting the pulses from the oscillator 150 in the manner described above. When the fourth clock pulse in this next sequence is counted by the counter 162, the counter 172 is incremented by 1 by the output on the line 170 to a count of 2. On the third successive depression of the switch 144, the counter 162 again commences counting the pulses from the oscillator 150 in the manner already described. When the fourth pulse in this sequence is counted by the counter 162, the output on line 170 increments the counter 172 to a count of 3. Consequently, the output $Q_3$ on line 190 goes high to disable the counter 172 so that with three or more sequential depressions of the switch 144, the counter 172 remains high at its output $Q_3$. Also, the flip-flop 128 is clocked so that the low level at its input D is transferred to the output Q on the line 228 to remove the reset on flip-flop 126 and the output $\overline{Q}$ goes high on the line 120. Again, the succeeding clock pulses 5-9 at the outputs $Q_5$–$Q_9$ of the counter 162 have no relevance at this time except that the counter 162 is disabled from counting additional pulses by the output on line 182. When the switch 144 is released after the third depression, the counter 162 is again reset by the high on line 166 and the oscillator 150 is de-energized.

Moreover, the high signal on the line 190 is inverted by the inverter 192 and then fed to the NAND gate 196 to provide a high signal on the line 198 to reset the counter 200. This high signal on the line 198 also resets the flip-flops 130, 178 and 180. After this reset signal on line 198 is generated, the circuit 118 is now prepared for writing the combination 1, 2 into the memory 122.

The memory 122, when provided with an address from the address counter 200, will write data at its inputs D1 and D2 into two respective channels. In the present example, five addresses will be generated for the five bits to be entered into each channel of the memory. The bit stream to be entered in one channel via input D1 will be 01001 corresponding to the combination 1, 2. A bit stream of 00001 will be entered in the second channel via the input D2 for reasons which will become apparent below.

To store the combination, and keeping in mind that the program switch 120 is still closed, the switch 132 is depressed by rotating the handle member 44 counterclockwise. This depression of the switch 132 provides a low signal on the line 134 which results in a high signal on the line 186 resetting the counter 172. Consequently, a low signal is provided on the line 190, ultimately resulting in a low signal on the line 198 due to the inverter 192 and the NAND gate 196, whereby the counter 200 can commence counting since its reset at input R is removed. Also, the signal on line 134 is fed through the NAND gate 138 to the oscillator 150 as well as through the inverter 164 to the counter 162. Consequently, the counter 162 commences counting the pulses from the oscillator 150. Further, the low signal on the line 134 is provided to the data input D1 of the memory 122.

When the fourth pulse from the oscillator 150 is counted by the counter 162, the output on line 170 increments the counter 200 by 1 to provide address number 1 for the memory 122. The fifth pulse counted by the counter 162 from the oscillator 150 enables the memory 122 via the output on the line 184. The sixth pulse counted by the counter 152 provides a high signal on the line 173 so that both inputs to the gate 174 on the respective liners 173 and 210 are high and the output on line 202 goes low to write the data into the memory 122. Consequently, a "0" bit at the data input D1 and a "0" bit at the data input D2 are written into the separate channels in the memory 122 at the address number 1. The successive pulses from the sixth pulse counted by the counter 162 have no effect on the memory 122.

Then, the switch 144 is depressed by rotating the handle member 44 clockwise and the counter 162 begins counting the pulses from the oscillator 150 as already described. When the fourth pulse is counted by the counter 162, the output on the line 170 increments the counter 200 by 1 to provide address number 2 for the memory 122. On the fifth pulse, the memory 122 is enabled by the output on the line 184 and on the sixth pulse the output on the line 173 results in the writing of the data into the memory 122. At this time, a high signal is at memory data input D1 since the switch 132 has not been depressed while a low signal is at the data input D2. Therefore, "1" and "0" bits are respectively written into the two memory channels at the address number 2. The pulses succeeding the sixth pulse counted by the counter 162 have no effect on the memory 122.

Next, the switch 132 is depressed two times in succession by rotating the handle member 44 counterclockwise twice in succession. In a manner already described, the counter 200 will be incremented by 1 with each depression of the switch 132 so that address number 3 and 4 will be provided for the memory 122. Therefore, two successive "0"'s will be entered into the one channel of the memory 122 via the memory input D1 and two successive "0"s will be entered into the other channel of the memory 122 via the input D2.

Next, the switch 144 is depressed by rotating the handle member 44 clockwise. As described above, the partition bit "1" is now entered into memory 122 at address number 5 via D1. Also, it will be seen that a "0" bit is entered into memory 122 at address number 5 via D2, but this will be changed to a "1" bit as described below.

As discussed above, five bits have been written into each of the channels of the memory 122 via the data inputs D1 and D2. At this time, programming is complete except that the "0" bit in the second chnanel of memory 122 at address number 5 should be changed to a "1". This change is achieved by first opening the switch 120 and then depressing once the switch 144 or switch 132.

More particularly, with the switch 120 open, line 124 is high, providing a high at input D2 of memory 122 and a high at inputs D of flip-flops 126, 128 and 130. When switch 144 of switch 132 is then depressed once, counter 162 is enabled and oscillator 150 starts pulsing. The third oscillation pulse causes line 168 from counter 162 to go high. This clocks the flip-flop 126 to transfer a high from the input of flip-flop 126 to line 214. The resulting high on the input S of flip-flop 130 forces its output $\overline{Q}$ low which disables the address counter 200 via line 216. The fourth oscillation pulse from the oscillator 150 counted by counter 162 therefore cannot increment the counter 200, which thus remains at address number 5. The fifth pulse from oscillator 150 counted by counter 162 enables the memory 122 and the sixth pulse counted by counter 162 writes a "1" into address number 5 of memory 122 via D2.

It should be noted that if the switch 144 were closed in completing the programming after opening switch 120, a "1" bit again will be entered via D1 into address number 5 of memory 122, and this is the proper partition bit. If the switch 132 were closed in completing the programming, a "0" bit will be entered via D1 into address number 5 and this is an improper partition bit. However, this "0" bit will automatically be changed to the proper partition bit "1" if the lock 10 is correctly manipulated for opening it the first time after programming, as will be described.

As noted above, after the switch 120 is opened, the switch 144 can be closed to complete the programming. Alternatively, this last step in the programming can be left undone until the lock 10 is manipulated to be opened by an authorized user. This is because in opening the lock 10, the switch 144 should be first closed three times in succession, as will now be described.

To open the lock 10, therefore, after opening switch 120, the switch 144 is depressed once by rotating handle member 44 clockwise. As described above, this would convert the fifth bit entered via D2 of memory 122 to a "1". It would also increment the counter 172 to a count of two, since the switch 144 has been closed just prior to opening switch 120. The switch 144 is then depressed a second time and this will increment the counter 172 to a count of three. As output $Q_3$ fo counter 172 goes high, flip-flop 128 is clocked, whereby since input D of this flip-flop 128 is high, the flip-flop 126 is reset via line 228. Line 214 will thereby go low to remove the set S on flip-flop 130. Since the input R of flip-flop 130 is high via line 198, the output $\overline{Q}$ on line 216 goes high, enabling counter 200 which is reset by the high on line 198.

The output $\overline{Q}$ of flip-flop 128 also goes low on line 210, disabling gate 174 to prevent any write pulses from entering the memory 122. The line 210 also enables the timer flip-flop 220 via OR gate 221 by removing the high on the reset line 210.

The circuit 118 has now been reset, and the combination 01001 has been stored in one channel of the memory 122 and the signal 00001 is in the other channel of the memory 122. The switch 144 should then be closed a third time in succession after opening switch 120. This will not change the state of the circuit 118 since counter 172 will remain at a count of three. However, this third successive depression of switch 144 is performed for the two following reasons.

First, by having the user always depress the switch 144 three times in succession after opening the switch 120, and by having the user commence programming the lock 10 by first depressing the switch 144 three times in succession, as described above, this has the advantage of making the programming substantially similar as opening the lock 10. This will become more apparent from the discussion below. Also, if the fifth bit entered in memory 122 via D2 is changed from a "0" to a "1" by closing switch 132, as mentioned above, it will require three successive depressions of switch 144 following the opening of switch 120 to reset counter 200. Furthermore, it will now be seen that should the switch 132 be so closed, then the following first depression of the switch 14 will change bit five entered in memory 122 via D1 from a "0" to a "1".

Another feature of the programming of the lock 10 should be noted at this time. After the switch 120 is opened, as already described completion of the programming can await the opening of the lock 10. Between the time of the opening of the switch 120 and the authorized opening of the lock 10, an unauthorized user could jiggle the handle member 44, whereby switch 144 or switch 132 or both could be closed. This would complete the programming and thereby prepare the circuit 118 for opening with entry of the correct combination.

To now continue opening the lock 10 after resetting the counter 200, the combination 01001 must be entered into the circuit 118. To do this, the switch 132 is depressed by rotating the handle member 44 counterclockwise. This resets the counter 172 via the inverter 136 and energizes the oscillator 150 via the gate 138. The fourth oscillator pulse counted by the counter 162 then increments the counter 200 to a count of 1 corresponding to address number 1, and the fifth pulse enables the memory 122 via the line 184. Consequently, the output from the memory 122 for the address number 1 will be "0" and "0" on the respective lines 204 and 206 for the two channels of data previously stored in the memory 122. The gate 140, which is a comparator, thus receives a "0" at each of its two inputs, i.e., a "0" on the line 204 and a "0" on the line 134 coupled to the switch 132. The gate 140 goes low when its two inputs are equal; hence, the output on the line 208 is low. When the counter 162 counts the seventh pulse from the oscillator 150, the high going signal on the line 176 clocks the flip-flops 178 and 180. Accordingly, the flip-flop 178 transfers the low signal on the line 208 to the output Q on the line 212 and the flip-flop 180 transfers the low signal on line 206 to its output Q on the line 222.

Next, the switch 144 is closed by rotating the handle member 44 clockwise, followed by closing the switch 132 twice in succession by rotating the handle member counterclockwise. This will result in the next three bits of the combination being compared by the gate 140 with the corresponding three bits stored in the memory 122. Since each of these comparisons show an equality of these bits on the lines 134 and 204, the output on the line 208 will remain low.

Subsequently, the switch 144 is closed by rotating the handle member 44 clockwise to produce the fifth bit of the combination. On this last comparison made by the gate 140, the output on the line 208 remains low since the two inputs on the line 134 and 204 are equal, i.e., a "1". The output on the line 212 is therefore low so that the flip-flop 130 does not toggle. Accordingly, a high signal remains on the line 216 coupling the output $\overline{Q}$ of the flip-flop 130 to one input of the gate 142. The other input to the gate 142 on the line 134 is also high so that a high signal is gated on the line 218 to the input D of the flip-flop 220. On this last depression of the switch 144, the output from the address number 5 on the line 206 is high and this is transferred by the flip-flop 180, due to the high going signal on the line 176, to the output Q on the line 222. Therefore, the flip-flop 220 is clocked to transfer the high on the line 218 to the output Q of this flip-flop 220, whereby a positive exponential voltage is provided via $R_6C_3$. When the voltage reaches, for example, 0.45V, which s set to occur after a period of approximately one second, the flip-flop 220 is reset. During this one second interval, the flip-flop 220 provides a low or control signal on the line 224 which is inverted by the inverter 226 to energize the electromagnet 100 for this one second interval. The signal on the line 224 also resets the counter 200 and the flip-flops 130, 178 and 180 via the line 198.

In the above example, the combination 1,2, has been correctly entered by properly manipulating the handle member 44 to unlock lock 10. After the electromagnet 100 has been energized, the handle member 44 can be manipulated as will be further described to retract the bolt 43*a* and open the door D. If an incorrect combination is provided by improperly manipulating the handle member 44, the electromagnet 100 will not be energized and the lock 10 will remain locked. For example, assume that the combination tried is 2, 1 which, in digital form, is 00101. When the switch 132 is first closed to provide the first "0" bit, the circuit 118 acts as described before. However, when the switch 132 is depressed successively a second time, the gate 140 will have non-equal inputs on the lines 134 and 204 since there will be a "0" on the former and a "1" on the latter. Therefore, the signal on the line 208 is high and ultimately the output $\overline{Q}$ of flip-flop 130 goes low to disable the gate 142 and prevent the flip-flop 220 from performing its timing function. The low signal on the line 216 also disables the address counter 200. The flip-flop 130 will remain in this state until it is reset by a high signal on the line 198.

With reference to FIG. 3, each time the handle member 44 is rotated clockwise to depress the switch 144, the tang 64 will rotate the lever 80 counterclockwise to bring the ring 92 into contact with the electromagnet 100. Also, the surface 60*b* will come into contact with the locking pin 22 to prevent a sufficient clockwise rotation of the handle member 44 to move the actuator 116 for retracting the bolt 43*a* from the doorjamb. Since the electromagnet 100 will not be energized to retain the ring 92 against the magnet 100 until the correct combination has been entered, the handle member 44 is returned to the position shown, with the ring 92 moving to the position illustrated bringing the end 80*b* back to the slot 62. As already described, with the lever 80 in the position shown in FIG. 3, when the handle member 44 is rotated counterclockwise, the surface 62*a* will come in contact with the end 80*b* to prevent sufficient rotation to release the bolt 43*a*.

However, when the correct combination has been generated by rotating the handle member 44 in a clockwise direction to close the switch 144 and generate the fifth bit of the combination, the tang 64 will have rotated the lever 80 to bring the ring 92 into contact with the magnet 100 which will be energized for approximately one second. With this energization of the magnet 100, the ring 92 will remain in contact with the magnet for one second to keep the end 80*b* out of the slot 62. Therefore, the handle member 44 can then be rotated sufficiently in a counterclockwise direction to bring the surface 60*a* towards the locking pin 22. During this extended counterclockwise rotation, the surface 58*a* on the tube 46 will move the actuator 116 a sufficient distance to slide the latch plate 18 via the pin 24 in the + X direction to unlock the lock and enable the shaft 30 to spring upwards to its FIG. 1 position. Also, the bolt 43*a* can now be released from the doorjamb to open the door D. When the magnet 100 is de-energized after the one second interval, the ring 92 will remain against the magnet 100 since the pin 104 will have moved with the latch plate 18 to keep the lever 80 pivoted with the end 80*b* out of the slot 62.

As may be appreciated, therefore, the lever 80 is used to prevent or block unlocking of the lock 10 when the handle member 44 is moved in the counterclockwise direction, which movement is required for unlocking the lock. The lever 80, however, is manually moved away from this blocking state by a clockwise movement of the handle member 44, which movement is one other than that used to unlock the lock 10. The electromagnet 100, when energized, maintains the lever 80 in the non-blocking state, thus allowing the handle member 44 to move in the counterclockwise direction to unlock the lock 10.

Also, two or more integrated circuits such as circuit 118 can be housed within the handle 38 to provide for two or more combinations for each lock. Each added combination would require one integrated circuit 118 and a program switch 120 so that, for example, for two combinations there would be two circuits 118, two program switches 120 each coupled to a respective circuit 118, and one set of switches 132, 144 common or in parallel to each circuit 118. Each circuit 118 would be programmed in the same manner as already described by closing and opening the respective program switch 120 and manipulating the switches 132, 144 with handle member 44. The output of each circuit 118 would be in parallel with electromagnet 100 to energize this magnet 100 to unlock the lock as already described.

One reason for having two or more combinations for each lock 10 is to utilize the lock 10 similarly to using a master key. Fo example, one combination in each lock 10 on a number of doors could be a master combination known only by a selected person to open these doors, while the other combination in each lock 10 would be different from each other so that only different individuals allowed in a given area could access such area.

As may be appreciated by considering the electronic components shown in FIG. 4, the circuit 118 is relatively simple and very suitable for integrating onto a relatively small and inexpensive CMOS integrated circuit. This is indicated in FIG. 2 in which the circuit 118, except for the switches 120, 132 and 144, in contained in an integrated circuit mounted on a board which is small enough to fit in the interior of a standard size hollow handle 38.

The gate 142 of circuit 118 is employed to account for the case where an unauthorized user has managed to enter correctly every bit of the combination except the last one because he incorrectly thinks the combination is larger than the progrmamed combination. That is, in the present example, the stored combination is given as 1, 2, but an unauthorized user may think the combination is 1, 3, which digitally is 010001. It can now be seen that if the unauthorized user correctly manipulates the handle member 44 to enter 0100 (the first four bits of the combination), then on manipulating the handle member 44 to enter another 0, the gate 142 can not be enabled to turn on the timer 220. Without the gate 142, upon entry of the incorrect fifth bit the magnet 100 would be energized since the clock input C of flip-flop 180 would be high at this time on depression of either switch 132 or 144.

The circuit 118, as shown in FIG. 4, is powered by a source +V which, as illustrated in FIG. 2, is a 9V mercury battery. Such a battery B is small and can therefore also be easily housed within the handle 38. Only a low power battery B is required because the circuit 118 and the electromagnet 100 require little current. The circuit 118 requires only approximately 0.000001 amps. to 0.000005 amps depending on temperature and moisture. This is equal to about 20,000 to 100,000 hours of battery life if the lock 10 is not activated. The electromagnet 100 requires only about 10 ma when it is energized. If one half of the energy of the battery B is required for energizing the electromagnet 100, then about 9,000 unlocking operations could be performed. The electromagnet 100 requires only 10 ma because it is only activated to hold ring 92 when the ring 92 and the magnet 100 are in physical contact, i.e., when there is no air gap betwen the two. Otherwise, a greater current would be needed to energize the magnet 100 if it had to attract the ring 92 into contact with it. The force of the magnet 100 holding the ring 92 in contact with it, despite the small energization current, is greater than the force of the spring 102 acting to separate these two components.

The lock 10 also is versatile in view of the easy manner in which different combinations can be programmed into the memory 122. If, for example, unauthorized personnel learn of the combination, the lock 10 can be readily reprogrammed with a new combination to prevent unauthorized access to a protected area. Its versatility is also such that a plurality of the same locks 10 can be bought and installed on different doors in a given building with each lock having a different combination programmed into it. Furthermore, the lock 10 is such that it can be opened completely in the dark or by blind persons since once the handle member 44 is grasped, its manipulation is simple.

Furthermore, it may be appreciated that while only a two character combination 1, 2 has been given as an example, any amount of characters can be used for the combination and programmed into the memory 122. The capacity of the memory 122 will depend not only on the amount of characters in the combination, but on the value of each character. The amount of characters determines the amount of partition bits which would be needed, so that, for example, a six character combination requires six partition bits, i.e., "1"'s. The value of each character determines the number of "0" bits that must be entered into the memory 122, so that, for example, a character 7 in the combination would require seven "0" bits.

The lock 10 has been described as utilizing a rotational movement of the handle member 44, both clockwise and counterclockwise, from a neutral position shown in FIG. 3, to generate the combination. However, other movements of the handle member 44 could be used to generate the combination. For example, the handle member 44 could be assembled to have both push-pull and rotary motion. The push-pull motion would be used to close the switches 132 and 144 suitably located adjacent a tube like the tube 48 so that, for example, pushing in from a neutral position would close the switch 132 and pulling out from the neutral position would close the switch 144. This push-pull motion could also be used to actuate the lever 80 as already described. After the combination has been generated, the handle member 44 would be free to be rotated to retract the bolt 43*a* from the doorjamb.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An electronic digital combination lock, comprising:

(a) a frame;

(b) bolt means for moving in relation to said frame;

(c) electronic circuit means, responsive to a predetermined combination signal, for generating a control signal, including switch means selectively controllable for generating digital signals, said electronic circuit means further including programmable signal storing means and selector means coupled thereto for switching between a program mode for receipt of said digital signals from said switch means to store and establish said combination signal therein, and an operating mode for receipt of said digital signals to generate said control signal upon receipt of said combination signal;

(d) handle means, coupled to said frame, for moving said bolt means, including a handle, selectively movable, for controlling said switch means to produce siad digital signals; and (e) means, responsive to said control signal, for permitting said handle means to move said bolt means a certain distance.

2. An electronic digital combination lock, comprising:

(a) a frame;

(b) bolt means for moving in relation to said frmae;

(c) electronic circuit means, responsive to a predetermined combination signal, for generating a control signal, including first and second openable and closeable switches selectively controllable for generating digital signals;

(d) first handle means, coupled to said frame on one side of said frame, for moving said bolt means, including a handle selectively movable for closing said first and second switches, respectively, to produce the predetermined combination signal to unlock the lock;

(e) means responsive to said control signal for permitting said first handle means to move said bolt means a certain distance; and (f) second handle means mounted to said frame from the opposite side of said frame in axial alignment with said first handle means, said second handle means being coupled for moving said bolt means the certain distance independently of said means responsive to said control signal and without a combination, and said first handle means moving said bolt means independently of said second handle means.

3. In a lock including a movable bolt assembly, movable handle means, locking means mounted for movement between a blocking position locking said bolt assembly against movement to an open position and a releasing position permitting movement of said bolt assembly to said open position, and energizeable electromagnet means positioned to hold said locking means in said releasing position upon movement of said locking means to said releasing position and having electrical circuit means responsive to an input to energize said electromagnet means, wherein the improvement in said lock comprises:

said handle means being coupled to all of:

(i) said circuit means to provide said input to said circuit means energizing said electromagnet means upon movement of said handle means in a predetermined manner, (ii) said locking means for movement of said locking means to said releasing position for holding by said electromagnet means when energized, and (iii) said bolt assembly for movement of said bolt assembly to said open position after movement of said locking means to said releasing position and energization of said electromagnet means.

4. A lock according to claim 3 wherein, one of said handle means and said locking means has an opening for receiving a remainder of said handle means and said lockng means in said opening, and means defining said opening for forcing said one of said locking means and said handle means away from said remainder.

5. The lock according to claim 3 wherein, said lock includes a frame, said handle means includes a first handle mounted on one side of said frame, and a second handle mounted coaxially with said first handle on an opposite side of said frame, said first handle being coupled to all of said circuit means, said locking means and said bolt assembly, and said second handle being coupled to said bolt assembly for movement of said bolt assembly to an open position independently of said circuit means.

6. In a lock including a movable bolt assembly movable between an open position and a bolted position, movable handle means, locking means mounted for movement between a blocking position locking said bolt assembly against movement to said open position and a releasing position permitting movement of said bolt assembly, and energizeable electromagnet means positioned to hold said locking means in said releasing position upon movement of said locking means to said releasing position and having electrical circuit means responsive to input to energize said electromagnetic means, wherein the improvement in said lock comprises:

said handle means including a pair of axially aligned oppositely facing handles, with a first of said handles coupled to said locking means for movement of said locking means to said releasing position for holding by said electromagnet means, and coupled to said bolt assembly for movement of said bolt assembly to said open position after movement of said locking means to said releasing position and energization of said electromagnet means, and a second of said handles coupled to said locking means for movement of said locking means to said releasing position and for holding of said locking means in said releasing position, and coupled to said bolt assembly for movement of said bolt assembly to an open position while holding said locking means in said releasing position independently of said electromagnet means;

said circuit means being responsive to a predetermined combination signal; and input means coupled to said circuit means and formed to generate a combination signal when input by a user energizing said electromagnet means to permit opening of said lock by said first of said handles.

7. In a lock including a movable bolt assembly, movable handle means, locking means mounted for movement between a blocking position locking said bolt assembly against movement and a releasing position permitting movement of said bolt assembly, and energizeable electromagnet means positioned to hold said locking means in said releasing position upon movement of said locking means to said releasing position and including an electronic circuit means responsive to an input signal and coupled to energize said electromagnet means, wherein the improvement in said lock comprises:

said circuit means being responsive only to a predetermined combination input signal to energize said electromagnet means;

input means formed to generate a combination of input signals in response to input from a user and coupled for communication of said input signals to said circuit means; and said handle means being coupled to said locking means for movement of said locking means to said releasing position for holding by said electromagnet means, and coupled to said bolt assembly for movement of said bolt assembly to an open position after movement of said locking means to said releasing position and energization of said electromagnet means.

8. The lock according to claim 7 wherein, said locking means is mounted for movement to a releasing position in which said locking means contacts said electromagnet means, said handle means is coupled to said locking means for movement of said handle beyond a position at which said locking means contacts said electromagnet means, and said electromagnet means being energizable with sufficient power to hold said locking means in said releasing position only when said locking means is in contact with said electromagnet means.

9. A combination lock having a number combination represented by a prestored sequence of first and second bits, in which each sequence of first bits represents a number of the combination and each second bit partitions adjacent sequences of first bits, comprising:

(a) selectively controllable switch means for generating the sequence of first and second bits, said switch means being unexposed to a user of the lock;

(b) movable means for controlling said switch means to generate the first and second bits, said movable means being movable in one direction to control said switch means to serially generate the first bits of a said sequence and being movable in another direction to control said switch means to generate the second bit; and (c) electronic circuit means for comparing the prestored sequence of first and second bits and the sequence of first and second bits being generated and for generating a control signal to open the lock when the prestored sequence of first and second bits and the sequence of first and second bits being generated are the same.

* * * * *